US010414631B2

(12) United States Patent
Vlasak et al.

(10) Patent No.: US 10,414,631 B2
(45) Date of Patent: Sep. 17, 2019

(54) DEVICE FOR DRIVING A HANDRAIL

(71) Applicant: INNOVA PATENT GMBH, Wolfurt (AT)

(72) Inventors: Pavel Vlasak, Prague (CZ); Jiri Drencko, Most (CZ)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 15/758,936

(22) PCT Filed: Sep. 19, 2016

(86) PCT No.: PCT/AT2016/000083

§ 371 (c)(1),
(2) Date: Mar. 9, 2018

(87) PCT Pub. No.: WO2017/044996

PCT Pub. Date: Mar. 23, 2017

(65) Prior Publication Data

US 2019/0039861 A1 Feb. 7, 2019

(30) Foreign Application Priority Data

Sep. 17, 2015 (AT) ..... 610/2015

(51) Int. Cl.
*B66B 23/04* (2006.01)

(52) U.S. Cl.
CPC ..... *B66B 23/04* (2013.01)

(58) Field of Classification Search
CPC ..... B66B 23/04
See application file for complete search history.

(56) References Cited

U.S. PATENT DOCUMENTS

| | | | | |
|---|---|---|---|---|
| 7,077,257 | B2 * | 7/2006 | Pietz | B66B 23/022 198/330 |
| 7,958,986 | B2 | 6/2011 | Winkelhake et al. | |
| 8,206,528 | B2 * | 6/2012 | Qureshi | B29C 63/0017 156/182 |
| 9,428,368 | B2 | 8/2016 | Trojer et al. | |
| 2016/0016760 | A1 * | 1/2016 | Srb-Gaffron | B66B 23/20 198/336 |

FOREIGN PATENT DOCUMENTS

| | | | |
|---|---|---|---|
| DE | 112006004175 | T5 | 10/2009 |
| JP | S4728872 | Y | 8/1972 |
| WO | 2004035451 | A2 | 4/2004 |
| WO | 2008076134 | A1 | 6/2008 |
| WO | 2014095429 | A1 | 6/2014 |
| WO | 2014142891 | A1 | 9/2014 |

* cited by examiner

*Primary Examiner* — Gene O Crawford
*Assistant Examiner* — Lester Ill Rushin
(74) *Attorney, Agent, or Firm* — Laurence A. Greenberg; Werner H. Stemer; Ralph E. Locher

(57) ABSTRACT

A device for driving a handrail of a passenger conveyor includes an endless drive element that is driven by a motor. Support rolls are disposed on the side of the drive element which lies opposite to the handrail, and the drive element is supported on the support rolls by a belt.

12 Claims, 3 Drawing Sheets

DEVICE FOR DRIVING A HANDRAIL

BACKGROUND OF THE INVENTION

Field of the Invention

The invention relates to a device for driving a handrail of a passenger conveyor comprising an endless drive element which is driven by a motor.

Such a device is disclosed, for example, in DE 11 2006 004 175 T5.

In such devices and also other generic devices, in particular when the drive of the handrail is not implemented by a form-locking connection but by a frictional connection, the problem arises for the drive element to be pressed sufficiently firmly against the handrail that no slip or as little slip as possible is present between the drive element and the handrail.

A further problem in such devices is the noise development by the device, which occurs both in form-lockingly and force-lockingly connection drive systems.

SUMMARY OF THE INVENTION

The object of the invention is to eliminate these problems as far as possible.

This object is achieved in a device of the type mentioned in the introduction, by support rolls being arranged on the side of the drive element which lies opposite the handrail and by the drive element being supported on the support rolls via a belt.

The belt in the present invention fulfils two tasks. The belt bridges the spacing between the support rolls so that the action of force is more evenly distributed from the support rolls onto the handrail. Moreover, the belt, which between the handrail and the support rolls runs freely therewith and therefore does not have to transmit any tensile forces, may be produced from a material which has good damping properties and as a result is able to dampen rolling noise which might occur when the support rolls roll directly on the drive element. As a result, therefore, it is also advantageous if the belt is produced from a very resilient material, in contrast to what is otherwise usual for belts in this technical field. Within the scope of the invention, therefore, it is preferred if the belt contains a damping material, preferably a polymer, in particular rubber or polyurethane, or a silicate or is produced from a damping material.

This is advantageous, in particular, when the drive element is a chain, in particular a roller chain. In the invention, chains, in particular roller chains, are preferred for the reason that they are able to transmit high forces and at the same time are relatively unsusceptible to wear.

It is further preferred according to the invention if the drive element comprises entrainment elements which act on the handrail. These entrainment elements are preferably elements which, in particular, in the case of systems operating by a force-locking and/or frictional connection, bring about a transmission of force to the handrail which is as effective as possible. This may be implemented firstly by shaping or secondly by an appropriate choice of material. Naturally, both measures may be combined together.

According to a preferred embodiment of the invention, an improvement to the force-locking connection by shaping may be implemented by the entrainment elements having a recess which widens in a substantially V-shaped manner, a projection which is arranged on the handrail and which preferably has a substantially V-shaped cross section engaging therein.

Further preferred embodiments of the invention form the subject-matter of the remaining subclaims.

BRIEF DESCRIPTION OF THE SEVERAL VIEWS OF THE DRAWING

Further features and advantages of the invention are disclosed from the following description of a preferred exemplary embodiment of the invention with reference to the accompanying drawings, in which.

DESCRIPTION OF THE INVENTION

Figure 1:
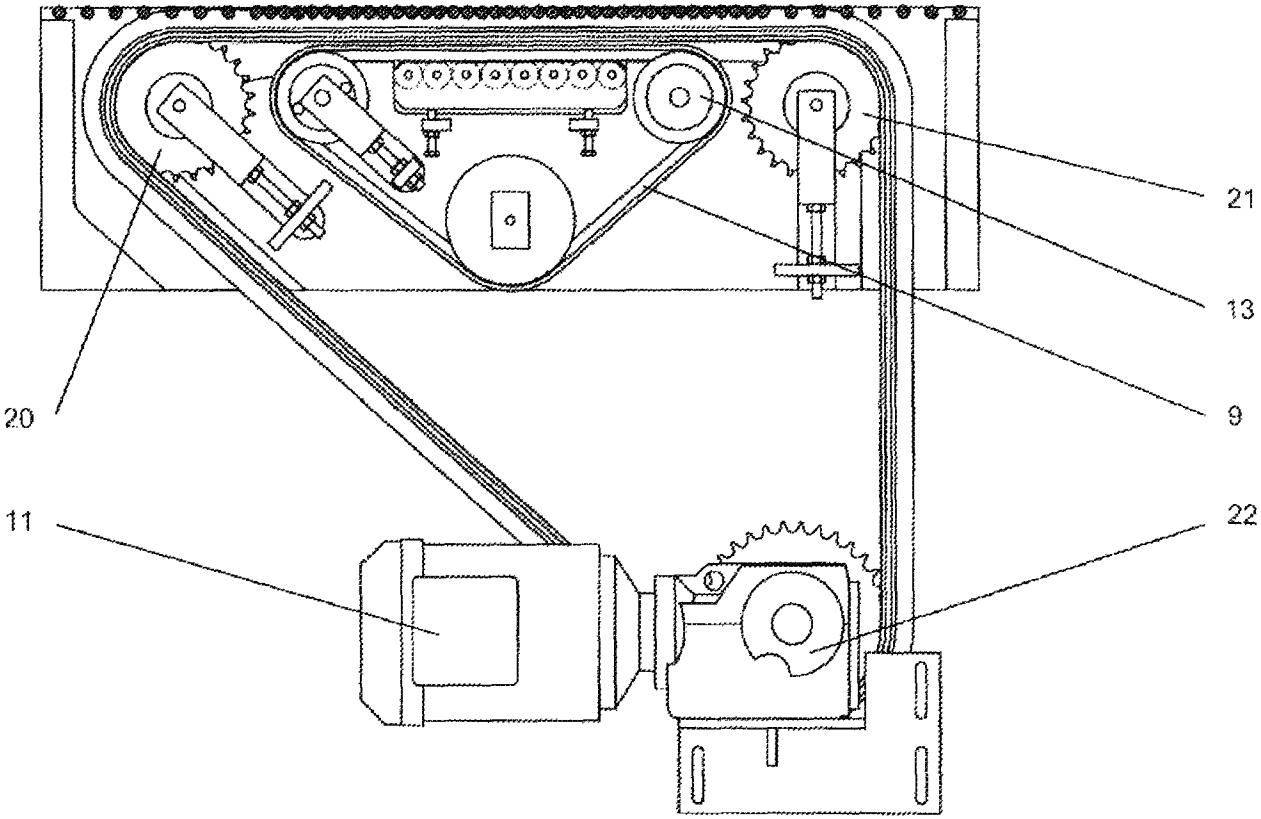
FIG. 1 shows a schematic side view of a device according to the invention.

The device according to the invention is a drive unit which may be arranged at any point of a passenger conveyor, for example a horizontal and/or linear moving walkway or an escalator. It may be seen that by means of the device according to the invention a handrail 1 may also be driven in the upper region of a balustrade 2, so that no additional space is required below the return run of the handrail in the lower region of the balustrade. It goes without saying, however, that the device according to the invention could also be used rotated by 180° for driving the return run.

In the embodiment shown, the handrail 1 has a substantially C-shaped cross section, wherein a projection 3 is arranged in the internal central region of the handrail 1. In theory, this projection 3 could comprise teeth for a positive engagement of a drive element 4 but in the present invention said projection is preferably continuously driven and, therefore, is driven by the drive element 4 only by a force-locking and/or frictional connection.

In the preferred embodiment shown, the drive element 4 comprises a roller chain 5, entrainment elements 6 being fastened to the chain links thereof, said entrainment elements having a recess which widens outwardly in a substantially V-shaped manner and which as a whole form a channel, the projection 3 being received therein.

Since the force transmission in the embodiment shown is implemented by a force-locking and/or frictional connection, it is important that the drive element 4 is pressed with sufficiently high force against the projection 3 on the handrail 1. According to the invention, support rolls 7 which are rotatably mounted on a holder 8 are provided to this end. The support rolls 7 are arranged on the side of the drive element 4 opposing the handrail 1, wherein according to the invention an endless belt 9 runs between the drive element 4 and the support rolls 7, said endless belt not being driven itself but being entrained by the drive element 4 which is driven by a motor 11, since the endless belt is clamped between the drive element 4 and the support rolls 7.

The belt 9 runs around two deflection rollers 12, 13 upstream and downstream of the holder 8 and/or the support rolls 7 and around a clamping roller 14 which is arranged below the holder 8.

In order to be able to adjust the contact pressing force of the support rolls 7 via the belt 9 onto the drive element 4, adjusting screws 15, 16 act on the holder 8, said adjusting screws being screwed to a frame 19 by clamping blocks 17, 18.

The drive element 4 is driven about a first gearwheel 20 and about a second gearwheel 21 and a drive pinion, not visible in detail, which is driven by the motor 11 via a gear mechanism 22.

The belt 9 preferably consists of a material which contains a polymer, preferably rubber or polyurethane, and has good damping properties in order to prevent noise development which could arise when rolling on the support rolls 7 and upon contact with the roller chain 5.

Figure 2:
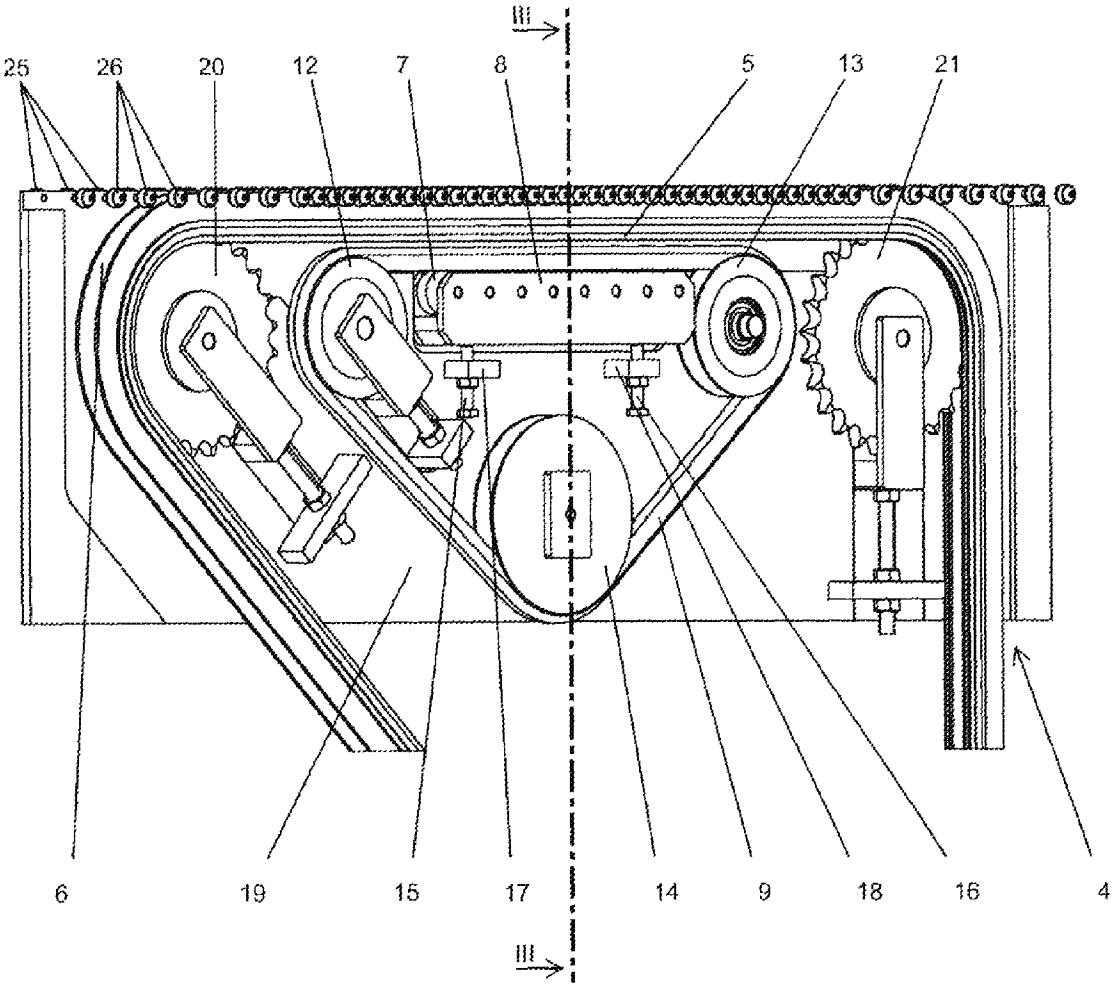
FIG. 2 shows a detail of the device of FIG. 1 in enlarged scale.
Figure 3:
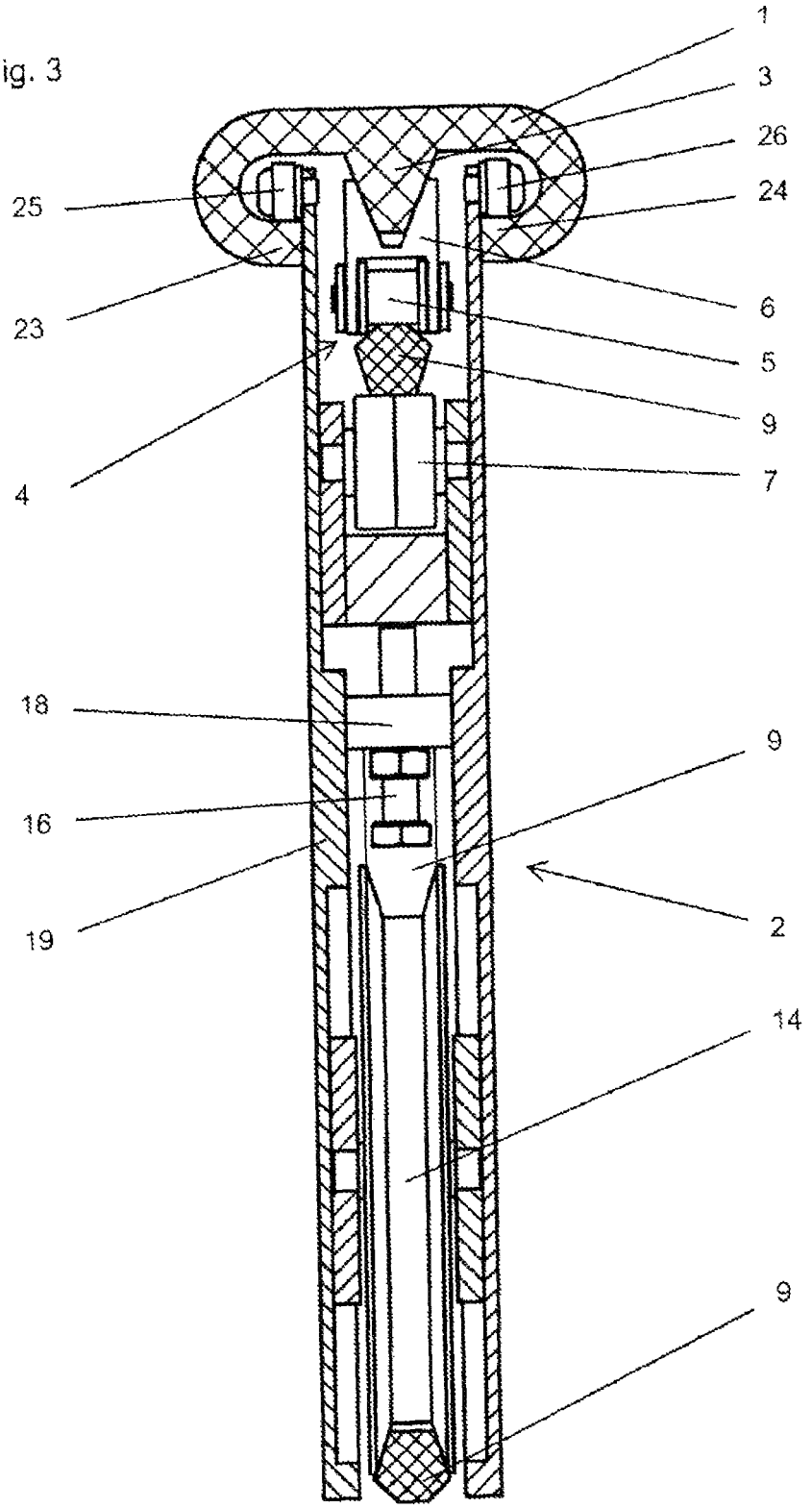
FIG. 3 shows a section through the device along the line III-III in FIG. 2 in the region of the drive element of the device.

As already mentioned in the introduction, the handrail 1 has a substantially C-shaped cross-sectional shape, wherein the free edges 23, 24 which correspond to the lips of a C-shaped profile are supported by the inner face of the handrail 1 by rollers 25, 26. In FIGS. 1 and 2, the rollers 26 illustrated to the right in FIG. 3 are visible for illustrative reasons, although the right-hand part of the frame 19 with the rollers 26 is not actually shown in these figures in order to open up the view of the interior of the device according to the invention.

It may be seen that in this embodiment (but not necessarily) the rollers 25, 26 are arranged in the region of the deflection rollers 12, 13 and therebetween in the region of the support rolls 7 at a narrower spacing than in the adjacent regions upstream and downstream thereof, in order to support the handrail 1 effectively against the force acting on the handrail 1 by the drive element 4 and to ensure a sufficiently fixed connection between the entrainment elements 6 and the projection 3 on the handrail 1.

The invention claimed is:

1. A device for driving a handrail of a passenger conveyor, the device comprising:

an endless drive element having a side lying opposite the handrail;

a motor driving said endless drive element;

support rolls disposed on said side of said drive element lying opposite the handrail; and a belt supporting said drive element on said support rolls.

2. The device according to claim 1, which further comprises a frame and rollers mounting the handrail on said frame.

3. The device according to claim 1, wherein said drive element includes entrainment elements acting on the handrail.

4. The device according to claim 1, wherein said drive element includes a chain.

5. The device according to claim 4, wherein said chain is a roller chain.

6. The device according to claim 3, wherein said drive element includes a chain having chain links, and said entrainment elements are disposed on said chain links.

7. The device according to claim 3, which further comprises a projection disposed on the handrail, said entrainment elements having a recess for receiving said projection.

8. The device according to claim 7, wherein said recess widens in a substantially V-shaped manner, said projection has a substantially V-shaped cross section, and said projection engages in said recess.

9. The device according to claim 1, which further comprises two deflection rollers and a clamping roller about which said belt is guided.

10. The device according to claim 1, which further comprises a frame, and a holder adjustably mounted on said frame, said support rolls being disposed on said holder.

11. The device according to claim 2, wherein the handrail has a substantially C-shaped cross section with free edges, and the free edges engage behind said rollers and bear against said rollers.

12. The device according to claim 2, wherein said rollers have a smaller spacing from one another in a region of said support rolls than in regions adjacent said region of said support rolls.

* * * * *